US005882427A

United States Patent [19]

Michanickl et al.

[11] Patent Number: 5,882,427

[45] Date of Patent: Mar. 16, 1999

[54] METHOD OF RECONDITIONING USED WOOD

[75] Inventors: Andreas Michanickl, Brunswick; Christian Boehme, Abbesbuettel, both of Germany

[73] Assignee: Fraunhofer-Gesellschaft zur Foerderung der angewandten Forschung e.V., Munich, Germany

[21] Appl. No.: 973,111

[22] PCT Filed: May 22, 1997

[86] PCT No.: PCT/DE97/01070

§ 371 Date: Feb. 2, 1998

§ 102(e) Date: Feb. 2, 1998

[87] PCT Pub. No.: WO97/46357

PCT Pub. Date: Dec. 11, 1997

[30] Foreign Application Priority Data

Jun. 4, 1996 [DE] Germany ..... 196 22 421.7

[51] Int. Cl.[6] ..... B08B 3/00; B08B 3/02; D21C 1/02; D21C 1/04

[52] U.S. Cl. ..... 134/6; 134/26; 134/28; 134/29; 134/30; 162/1; 162/63; 162/65; 162/81; 162/82

[58] Field of Search ..... 134/6, 26, 27, 134/28, 29, 30, 34; 162/1, 63, 65, 81, 82, 70

[56] References Cited

U.S. PATENT DOCUMENTS

| | | | |
|---|---|---|---|
| 102,665 | 5/1870 | Douglas | 134/30 |
| 783,868 | 2/1905 | Jarratt | 134/30 |
| 1,328,658 | 1/1920 | Fish, Jr. | 134/30 |
| 2,549,522 | 4/1951 | Reason | 134/28 |
| 3,707,436 | 12/1972 | O'connor | 162/63 X |
| 4,266,981 | 5/1981 | Tsao et al. | 162/82 |
| 4,512,813 | 4/1985 | Young | 134/27 |
| 4,734,138 | 3/1988 | Ely et al. | 134/27 |
| 5,378,323 | 1/1995 | Fransham et al. | 201/8 |
| 5,607,545 | 3/1997 | Henricson et al. | 162/65 X |

*Primary Examiner*—Jill Warden
*Assistant Examiner*—Saeed Chaudhry
*Attorney, Agent, or Firm*—Karl Hormann

[57] ABSTRACT

Method of separating the surface layer from the core of a piece of wood is described. In it, the surface of the piece of wood is initially pre-damaged or roughened and the piece of wood thus treated is thereafter soaked in water or an aqueous solution until the moisture of the wood in the surface layer is at least 30%. Thereafter, the piece of wood thus pre-treated is subjected to a steam process with steam at a temperature of 120 ° to 160 ° C. by which the surface layer to be removed is solubilized to an extent sufficient for removal from the piece of wood in a following step.

15 Claims, No Drawings

METHOD OF RECONDITIONING USED WOOD

BACKGROUND OF THE INVENTION

1. Field of the Invention

The invention relates to a method of reconditioning used wood in which contaminated surface portions are removed by mechanical and chemical operations.

2. The Prior Art

Utilization of used wood as a working material is often particularly problematic because of various contaminations. Most often, the wood is contaminated by organic and inorganic wood preservatives which as a rule are applied to the surface of the wood by drenching or immersion processes, or after construction. Because of the manner in which the wood preservatives have been applied and because of the structure of the wood these wood preservatives are directly fixed only to the surface of the wood, i.e. penetrating not more than few millimeters thereof. Moreover, used wood may be contaminated by inorganic or mineral contaminations from building materials such as, for example, cement, gypsum, concrete or tar paper. These contaminations, because of the nature of utilization of the wood, e.g. to form support or ceiling beams, are also restricted to the surface. In the case of building wood, demolition wood or pallets, nails, screws and staples of iron or ferrous materials are often present. In most cases, they are separated from the chips after cleaning of the wood by magnetic separators and air separators. Together with the types of contamination referred to above, one often encounters weather-induced wear occurring even in protected wood made perceptible by embrittlement and graying of the surface of the wood. In all of the cases described, removal of only a certain surface layer of a piece of wooden building material is necessary, and the remaining core may be used again as good untreated and undamaged wood material. Mechanical reprocessing of used wood by shaving off its surface has been recognized as possible. because of the different and irregular shapes of used wood and its varying sizes, such a process is, however, very complex and expensive. Moreover, machines used for such purposes are subjected to damage from attached minerals or metal parts. For that reason, an economic reconditioning of used wood has hitherto not been possible in cases where surfaces have had to be removed.

OBJECTS OF THE INVENTION

It is a task of the present invention to provide a process which makes it possible in a simple manner to remove the surface layer of used wood pieces regardless of their size and condition, and to leave the remaining wood untreated to such an extent, or to preserve it such that it may be worked with or utilized again.

DETAILED DESCRIPTION OF THE INVENTION

This task is accommodated by a chemo-thermal method wherein the surfaces of used wood building materials are in a first step mechanically roughened at all sides by toothed rolls and knife rolls and/or by treatment in a drum rotor. Wooden pieces with strongly weathered surfaces and edges, coarse cement and concrete contaminations as well as fungus and insect infections are separated from the wooden core which may be reused. If, for instance, the contaminations are removed in a rotating drum similar to those used, for instance, for barking new wood, roughening or breaking open or tearing open of the surfaces by incising or by toothed rollers before and/or after the rotor treatment is very effective for complete decontamination. Up to a certain extent, the proportion of removed contaminations is increased. Following the mechanical pretreatment the roughly precleaned used wood is soaked in water or in a solution of water and chemicals, and the chemicals dissolved therein may more easily penetrate into the roughened surface. Preferably, the wood is soaked until the water or solution in the surface portions to be removed has reached 30%. In this manner the surface is softened and swells. By adding chemicals to, or heating, the water this process may be enhanced. Penetration of the solution may be accelerated by surfactants. The process may also be accelerated by the application of a vacuum prior to the soaking, by placing the used wood into a vacuum pressure container. Additions of an acid an aggressive substance such as or basic solution may further enhance the solubilization of the surface of the wood with the contaminants contained therein, so that in the ensuing process steps they may thereafter be removed even more easily than by soaking in pure water. Nitric acid and sulfuric acid as well as a sodium hydroxide and potassium nitrate solutions are particularly well suited for this purpose. Dissolving-out of wood preservatives vatives may be prevented by complexing agents and other mordant chemicals. Certain wood preservatives may be destroyed during this process step by the acid additive as well as by the addition of other chemicals. Soaking and surface solubilization may also be enhanced by raising the temperature. Following the soaking treatment the used wood may be subjected to a steam process. By the action of the steam temperature, optimally from 120° to 160° C., the solubilizing effect of the soaking process is increased. It has been found that adding aggressive vaporous substances such as ammonia or ozone-for instance, further improves solubilization of the surface portions. Also, mycelia and spores as well as insects and insect larvae present in the wood are destroyed so that following its reconditioning the wood may be utilized again without posing any hazard. After steaming, the used wood in its hot state is fed to specially arranged high pressure water jets directed vertically or at an angle up to 85° from all sides against the softened or solubilized wood surfaces of the used wood article. The surface and any contaminants attached thereto are removed by the high pressure water jets. By skillfully controlling the water circulation and precisely controlling the process which prevents the washing out of wood preservatives, the water may be recirculated. Optionally, the water jet treatment may be preceded by subjecting the wood to mechanical treatment such as wire brushes and sand blasting, for instance.

The properties of the wood after termination of the process are very similar or superior to those of new wood. By the steam treatment and the increase of its moisture content the wood regains a certain elasticity which has a positive effect upon shredding and chipping. Because of aging, the reconditioned material will at the same time have fewer wood ingredients. Also, the water receptivity and swelling properties of the reconditioned wood are lower than those of new wood. It has been found that wood fiber boards of better dimensional stability and life expectancy may thus be produced.

Depending upon the contamination and moisture content of the wood, soaking of the used wood may not be necessary. If the wood is already very wet because of outside storage over an extended period, it probably may not have to be soaked. At low level contaminations and high soaking temperatures steaming may be unnecessary. If the temperature of the water or of the solution is between 90° and 100° C., for instance, a certain thermal "plastification" of the surface of the wood may thereby also be obtained simplifying subsequent removal by high pressure water jets, sand blasting or rotating wire brushes.

MULITPLE STAGE CHEMO-THERMO-MECHANICAL RECONDITIONING OF USED WOOD PRESENTATION OF THE PROCESS SEQUENCE

Mechanical breaking up or Roughening of Wood Surfaces for instance by Incising, Toothed Rollers or Rotating Drums Soaking in Solution at 10° C. to 100° C., in Pure Water or in Solutions Having Additives for Acceleration Softening Steaming at 100° C. to 160° C. at Normal or Super Pressure with or without Addition of Aggressive Substances Removal of Solubilized Surfaces in their Hot Condition by High Pressure Water Jets, Rotating Wire Brushes or the like Chopping of the Wood Core Relieved of Contaminations into Chips, Separating of Metal Parts Further Processing of the Chips into Shavings or Fibers for the Chip and Fiber Board Industry

EXAMPLE 1

Used wood parts of various dimensions with mineral attachments and a wood preservative applied to their surfaces by dipping taken from a rehabilitated building are roughened by toothed rollers at all surfaces to a depth of about 3 mm. Coarse contaminations are removed by this roughening. The receptability of the surfaces for an aqueous solution is enhanced. Thereafter, the wood parts are dipped into an aqueous solution set at a pH value of 1.5 by adding sulfuric acid. The temperature of the solution is 50° C. By heating the solution its penetration into the surface of the wood is accelerated. After 10 minutes, the wood parts are taken from the solution. The wood surfaces are now being softened. The core of the wood is not adversely affected. After the wood parts have dripped off over the dipping bath they are subjected to steam for 10 minutes at a temperature of 120° C. The surfaces of the wood parts are further softened and plasticized by the steam treatment. Insect and fungus infestations are also destroyed by the steam treatment. The plastification of the surfaces allows their easy removal in their hot state by high pressure water jets, sand blasting, wire brushes or the like. The wood core relieved of organic and inorganic contaminations may now be further processed to chips accompanied by the removal of any metal parts. The removed surfaces which form but a small portion of the entire mass of the wood may be incinerated in suitable equipment. The chopped chips may be used for the manufacture of chips and fiber boards or other fibrous materials.

EXAMPLE 1—TABLE

Chip boards (19 mm) made of nonreconditioned and of reconditioned used wood were examined. The used wood examined was wood from a demolished house built in the sixties.

| | | Chip Board from Used Wood from Demolished Build-without Reconditioning (Surfaces were not Removed) | Chip Board from Reconditioned Used Wood (Surfaces were Removed After Soaking in Sulfuric Acid Solution [pH <1.5, 20° C., 20 min.] and Subsequent Steam Treatment [at 120° C. 10 min.] |
|---|---|---|---|
| Raw Density | g/cm$^3$ | .683 | .679 |
| E-Module | N/mm$^2$ | 3100 | 3430 |
| Bending Strength | N/mm$^2$ | 18.51 | 21.67 |
| Transverse Tensile Strength | N/mm$^2$ | .34 | .41 |
| Peeling Strength | N/mm$^2$ | 1.02 | 1.27 |
| Shear Strength | N/mm$^2$ | 1.21 | 1.22 |
| Moisture at 20/65 | % | 9.3 | 9.8 |
| Swelling after 2 h % | | 2.51 | 2.35 |
| Swelling after 24 h % | | 11.99 | 10.49 |
| Water Absorption after 2 h % | | 10.42 | 9.74 |
| Water Absorption after 24 h % | | 50.87 | 48.42 |
| Perforator Value | mg/100 g | 6.4 | 6.5 |
| Sand Content | g/kg | 3.6 | .4 |
| PCP Content | ppm | 2 | n.m. |

We claim:

1. A method of reconditioning pieces of used wood carrying contaminants at its surface, comprising the steps of:

mechanically opening the surface structure of the wood;

soaking the wood in a fluid until the fluid in said surface structure amounts to at least 30%;

subjecting the wood to steam of a temperature between 120° and 160° C. thereby to solubilize said surface structure; and removing said solubilized surface structure.

2. The method of claim 1, wherein said wood is soaked in water.

3. The method of claim 2, wherein said wood is soaked in water containing an aggressive substance.

4. The method of claim 3, wherein said aggressive substance is from the group including nitric acid, sulfuric acid, potassium nitrate and sodium hydroxide.

5. The method of claim 1, wherein said surface of said wood is treated by a wood preservative and said fluid contains a complexing agent to insolubilize said wood preservative.

6. The method of claim 1, wherein an aggressive substance is added to said steam.

7. The method of claim 6, wherein said aggressive substance is from the group including ammonia and ozone.

8. The method of claim 1, wherein said steam is applied at no less than pressure.

9. The method of claim 1, wherein said surface is opened by at least one of incising, toothed rollers, knife rollers and drum rotors.

10. The method of claim 1, herein said fluid is at a temperature of between 60° and 100° C.

11. The method of claim 1, wherein said solubilized surface is removed by high pressure water jets.

12. The method of claim 11, wherein said high pressure water jets are directed against said surface at an angle between 85° and 90°.

13. The method of claim 11, wherein prior to said removal by high pressure water jets said solubilized surface is subjected to a mechanical removal step.

14. The method of claim 13, wherein said mechanical removal step includes at least one of wire brushing and sand blasting.

15. The method of claim 1, wherein said wood is cut up into chips following removal of said surface.

* * * * *